US005755431A

United States Patent [19]

Williams

[11] Patent Number: 5,755,431

[45] Date of Patent: May 26, 1998

[54] POST ASSEMBLY AND MOUNTING FITTING THEREFOR

[76] Inventor: Robert M. Williams, 10071 E. Atherton Rd., Davison, Mich. 48423

[21] Appl. No.: 617,053

[22] Filed: Mar. 18, 1996

[51] Int. Cl.[6] ..... E04H 17/14

[52] U.S. Cl. ..... 256/19; 256/59; 256/65; 248/523; 52/165; 403/225

[58] Field of Search ..... 256/19, 59, 63–66, 256/68, 70, 1, DIG. 5, 32, 47, 22, 13.1, 21, 10; 52/165, 153, 169.9, 146, 152; 248/530, 156, 523; 403/365–368, 371–372, 220–221, 223, 225, 227–228, 291

[56] References Cited

U.S. PATENT DOCUMENTS

| | | | |
|---|---|---|---|
| Re. 26,779 | 2/1970 | Weichenrieder | 52/146 X |
| 2,608,386 | 8/1952 | Hart | 256/65 |
| 2,913,202 | 11/1959 | Meldrum | 248/523 X |
| 2,930,640 | 3/1960 | Davis et al. | 403/228 |
| 3,007,726 | 11/1961 | Parkin | 403/372 |
| 3,385,565 | 5/1968 | Cuthbert | 256/13.1 |
| 3,531,068 | 9/1970 | Fischer | 403/220 X |
| 3,670,468 | 6/1972 | Cordell, Sr. | 256/47 X |
| 3,921,960 | 11/1975 | Bright | 256/59 X |
| 3,994,608 | 11/1976 | Swiderski et al. | 403/372 |
| 4,159,096 | 6/1979 | Chase | 248/523 |
| 4,636,106 | 1/1987 | Waisbrod | 403/225 X |
| 4,997,307 | 3/1991 | Schmanski | 256/1 X |
| 5,022,618 | 6/1991 | Barrett et al. | 248/156 X |
| 5,509,752 | 4/1996 | Kociser | 403/372 X |

FOREIGN PATENT DOCUMENTS

| | | | |
|---|---|---|---|
| 218166 | 7/1924 | United Kingdom | 403/226 |
| 2032486 | 5/1980 | United Kingdom | 256/65 |

OTHER PUBLICATIONS

"Postmaster™ Mailbox: Complete Mailbox Systems", The Bacova Guild Ltd., 1990.

"Recycled Plastic Lumber Fences", Aeolian Enterprises, Inc., Jan. 1994.

"How to Build and Install Vinyl Fence", The Home Depot.

"Perma-Fence", Beaver Industries, Mar. 1993.

Color Guard Fence Company Brochure.

Legacy Brochure, pp. 2–26.

*Primary Examiner*—Harry C. Kim

*Attorney, Agent, or Firm*—Harness, Dickey & Pierce, P.L.C.

[57] ABSTRACT

An apparatus and method for installing a post particularly for use with vinyl fencing. The apparatus includes a mounting fitting having a first member defining a web and an aperture and a second member defining a peripheral surface. The aperture formed by the first member is disposable about a stake such that the first member is engageable with the outer surface of the stake to frictionally support the mounting fitting thereon. The peripheral surface of the second member is connected to the first member by the web and is engageable with the inner surface of a hollow post to frictionally support the post about the stake. The related method for installing a post includes the steps of securing a mounting stake to a surface, frictionally coupling a mounting fitting to the stake, and sliding a hollow post about the stake and mounting fittings such that the mounting fitting frictionally supports the hollow post about the stake.

15 Claims, 4 Drawing Sheets

POST ASSEMBLY AND MOUNTING FITTING THEREFOR

BACKGROUND OF THE INVENTION

1. Technical Field

The present invention relates generally to an apparatus and method for installing a post and, more particularly, to an apparatus and method for securing a vinyl fence post to the ground through the use of a mounting stake and a mounting fitting.

2. Discussion

Fencing is most commonly manufactured from materials such as wood, metal, and, more recently, polyvinyl chloride extrusions (vinyl). The increasingly widespread use of vinyl fencing is attributable primarily to the extended useful life and low maintenance of these products. Recently, manufacturers of vinyl fencing products have developed a variety of post cap and rail styles that may be specifically tailored to individual job needs for contractors. It is anticipated that as production techniques for vinyl fencing evolve, the share of the fencing market garnered by these products will expand.

While vinyl fencing products have generally been accepted due to their longer life and low maintenance, the increased initial cost of these products has proved to be a significant impediment to expanding sales. Particularly, the material costs associated with the solid vinyl fencing are greater than that for fencing made of wood. Moreover, as the methods for installing each of these fencing materials is substantially the same, purchasers of vinyl fencing products are required to make a greater initial investment in a vinyl fence than would be necessary for wood fencing.

The installation procedures common to vinyl and wood fencing include securing several posts in a fence section, particularly the end posts, to the ground through the use of concrete filled post holes. Installing a vinyl fence post more specifically includes excavating a post hole, placing a vinyl post into the excavated holes, temporarily supporting the post straight and level, filling the hole with concrete, and allowing the concrete to set before proceeding with the installation of the fence rails. Sometimes, treated wood posts are inserted and secured inside the hollow vinyl post extrusions for additional strength and stiffness prior to setting the posts into the excavated holes. In order to further increase the use of vinyl fencing, a less labor intensive installation process is required.

SUMMARY OF THE INVENTION

Accordingly, the present invention provides an apparatus and method for installing a post that reduces the labor costs associated therewith. Particularly, the present invention includes a mounting fitting for securing a hollow post to a stake that is connected to the ground. The mounting fitting includes a first member defining an aperture and a web and a second member defining a peripheral surface connected to the web. The peripheral surface is adapted to frictionally engage the inner surface of the hollow post while the material of the first member surrounding the aperture is frictionally engageable with the stake. The method described and claimed herein for installing a post includes securing a stake in the ground, frictionally coupling a mounting fitting to the stake, and placing the post about the stake and in frictional engagement with the mounting fitting.

BRIEF DESCRIPTION OF THE DRAWINGS

The objects and features of this invention will become further apparent from a reading of the following detailed description taken in conjunction with the drawings, in which.

DETAILED DESCRIPTION OF A PREFERRED EMBODIMENT

Figure 1:
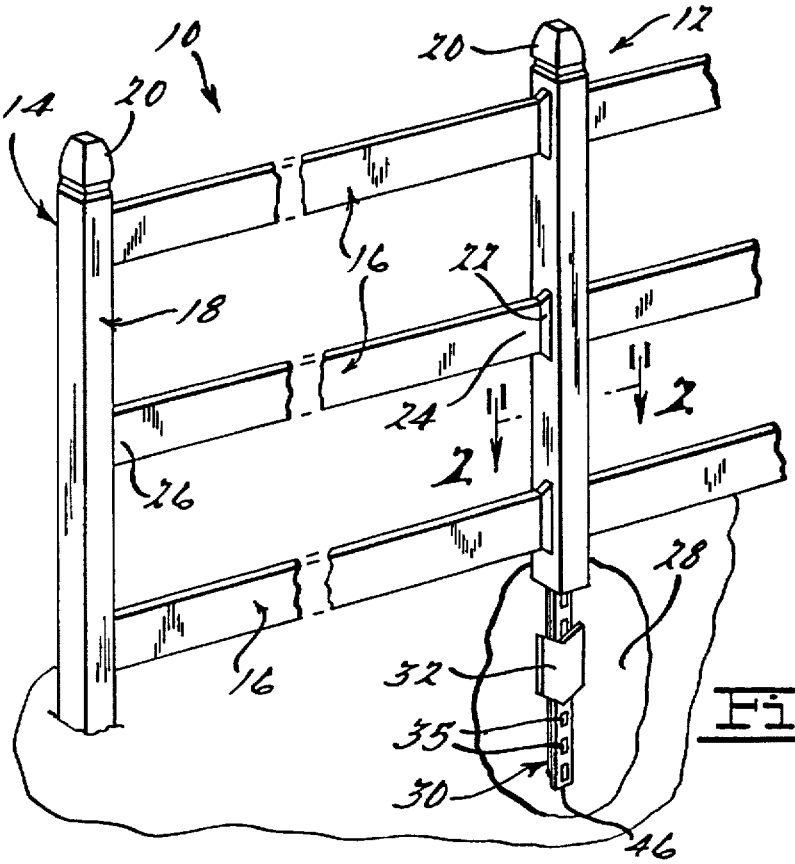
FIG. 1 is an overall view of a fence section including a pair of fence post assemblies in accordance with the present invention.

The following description of the present invention is specifically addressed to the vinyl fence post assembly illustrated in the drawings. However, one skilled in the art will appreciate that the invention described and claimed herein is equally applicable to post assemblies made from other products and for posts in other environments such as mailboxes, exterior lighting posts and the like.

FIG. 1 illustrates a section of vinyl fence 10 including a first vinyl fence post assembly 12 and a second vinyl fence post assembly 14 interconnected by a plurality of rails 16. Each of the first and second vinyl fence post assemblies 12 and 14, respectively, include a hollow vinyl post 18 and post top 20. A plurality of rails 16 are secured to vinyl post assemblies 12 and 14 most commonly through milled slots or holes formed in hollow vinyl post 18. However, as will be discussed in greater detail hereinafter, mounting apparatuses that provide greater flexibility in ordering and installing post assemblies 12 and 14 may be used. For example, as shown in FIGS. 1, 2, 3, and 6, rail mounting brackets 22 may be connected to each fence post assembly 12 and 14, respectively, in order to secure first and second ends 24 and 26, respectively, of each rail 16 to the appropriate fence post assembly.

Figure 2:
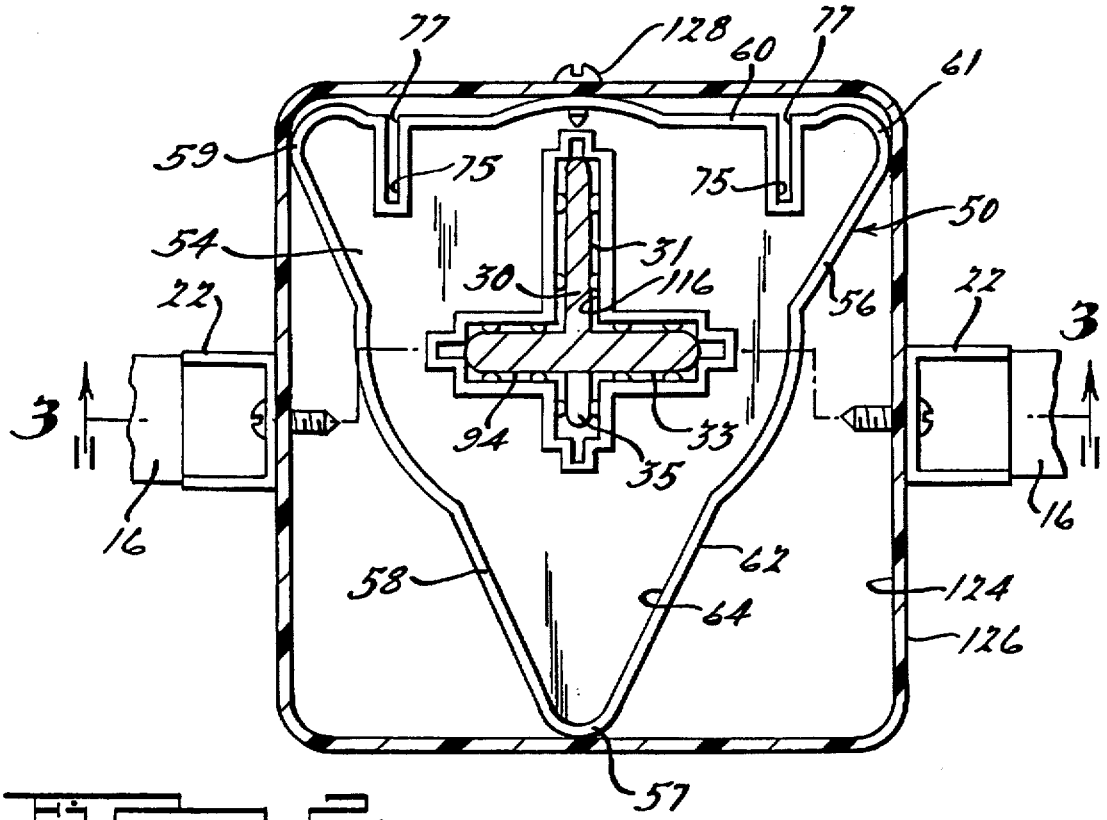
FIG. 2 is a sectional view of the fence post assembly taken along lines 2—2 in FIG. 1.
Figure 3:
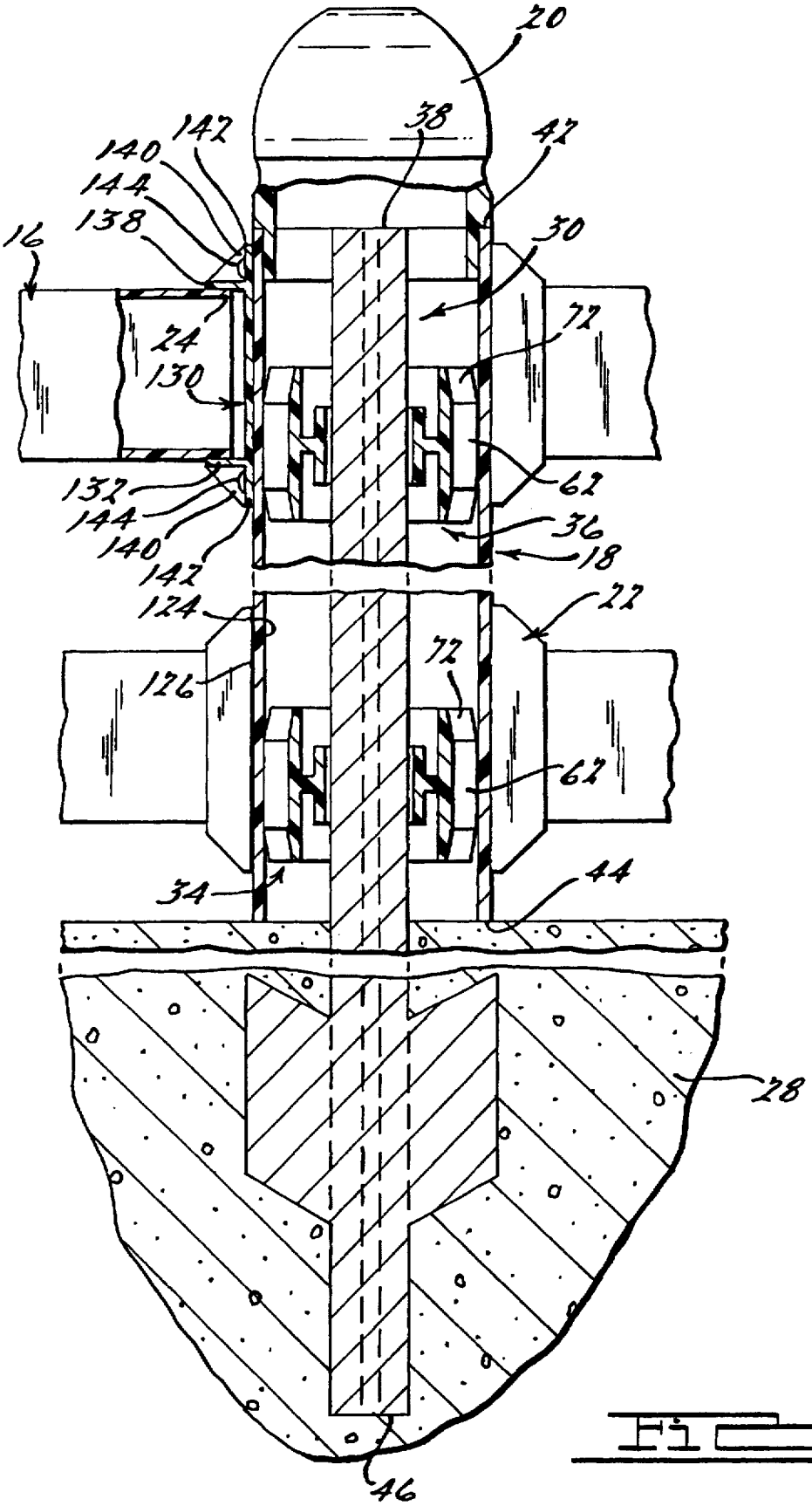
FIG. 3 is a sectional view of the fence post assembly taken along a plane indicated by lines 3—3 in FIG. 2.

With reference to FIGS. 1–3, first fence post assembly 12 is shown secured to the ground 28 through a metal stake 30. Stake 30 preferably includes a spade 32 that increases the bearing surface for the surrounding earth and, correspondingly, the ability of stake 30 to resist movement after installation. Spade 32 provides the further benefit of increasing the ease with which stake 30 may be installed in the correct orientation relative to previous post assemblies, i.e., to assure that the hollow vinyl posts 18 are installed with their respective rail mounting surfaces parallel to one another.

As will be described in greater detail hereinafter, fence post assembly 12 also includes a first mounting fitting 34 secured to stake 30 proximate to the surface of ground 28 and a second mounting fitting 36 secured proximate to a top 38 of stake 30 (FIG. 3). In the preferred embodiment, first and second mounting fittings 34 and 36, respectively, are secured approximately six inches from the surface of ground 28 and six inches from the top 38 of stake 30, respectively. Those skilled in the art will appreciate that the relative positions of first and second mounting fittings 34 and 36 may be varied without departing from the scope of the invention claimed herein.

With reference to FIG. 3, hollow post 18 is shown to include an open top and bottom 42 and 44, respectively, and is disposed about mounting stake 30 so as to frictionally engage first and second mounting fittings 34 and 36, respectively, whereby hollow post 18 is supported about and by stake 30. Post tops 20 are secured to each post 18 to cover open top 42 in a manner known to those skilled in the art.

Mounting stake 30 is preferably a standard steel fencing stake commonly available in the marketplace and is shown in FIG. 2 to include an exterior surface 31 defining a generally T-shaped cross-section and a plurality of equally spaced tabs 35 protruding from a leg 33 thereof. The preferred steel fencing stakes are most commonly manufactured by extruding steel in the cross-section shown and cutting the extrusions at the desired length. It will be appreciated by those skilled in the art that the process of extruding and severing stakes 30 often creates variations in the cross-sectional configuration of the stakes 30 at the top and bottom ends 38 and 46, respectively, thereof. The present invention accommodates this manufacturing variable in a manner hereinafter described.

Figure 4:
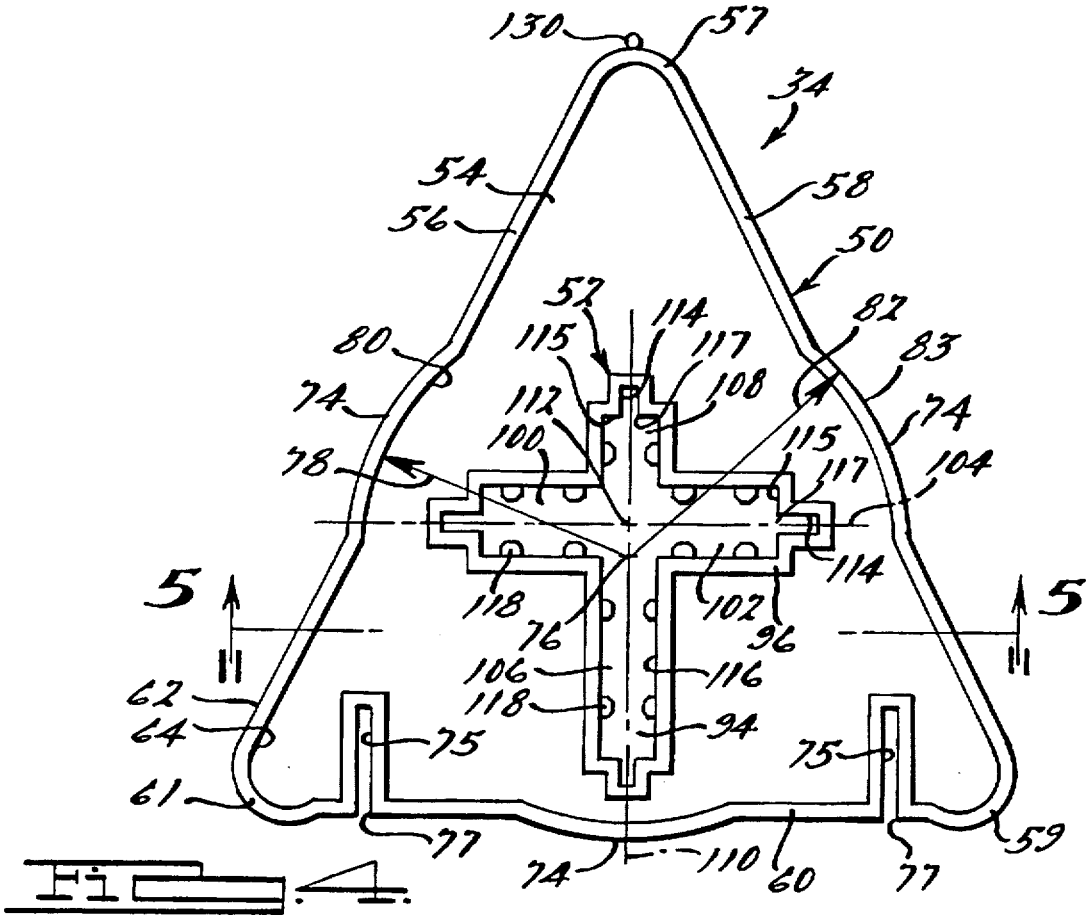
FIG. 4 is a top detail view of the mounting fitting.
Figure 5:
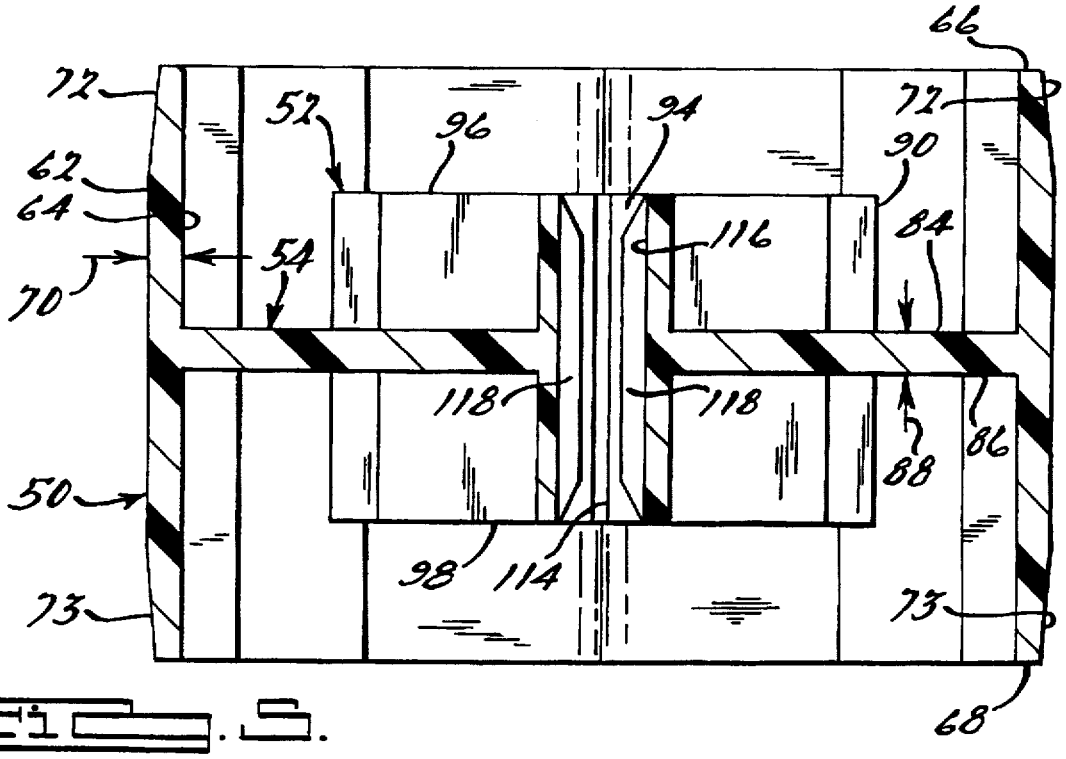
FIG. 5 is a sectional view of the mounting fitting taken along lines 5—5 in FIG. 4.

With specific reference to FIGS. 2, 4, and 5, mounting fittings 34 and 36 are preferably substantially identically configured members stamped, molded, or die formed from polyethylene or other suitable material known in the art into a triangular shape that defines a peripheral member 50 connected to a housing 52 by a web 54. In the preferred triangular configuration, peripheral member 50 includes a first side 56, a second side 58, and a third side 60 interconnected to form first, second, and third corners 57, 59, 61, respectively (FIG. 2). However, it should be appreciated that the mounting fitting may not only be manufactured from various materials but may also be formed in a variety of shapes without departing from the scope of the invention as claimed herein.

Peripheral member 50 further includes an outer surface 62, an inner surface 64, and first and second end surface 66 and 68, respectively (FIG. 5). The distance between the inner surface 64 and the outer surface 62 define a wall thickness 70 that, as best seen In FIG. 5, varies between first and second end surfaces 66 and 68. More, particularly, outer surface 62 is shown to converge toward inner surface 64 proximate to first and second end surfaces 66 and 68 thereby defining first and second tapered portions 72 and 73, respectively. As will be described in greater detail hereinafter, tapered portions 72 and 73 increase the flexibility of peripheral member 50 near end surfaces 66 and 68 thereby increasing the ease with which hollow post 18 slides over the respective mounting fittings 34 and 36 as well as allowing for tolerance variations in the interior dimensions of hollow vinyl post 18.

To further accommodate hollow post 18, as well as to relax the manufacturing tolerances required for the mounting fittings, each mounting fitting includes a pair of slots 75 formed in peripheral member 50 and, preferably, in third side 60 thereof as shown in FIG. 2. As will be described in greater detail hereinafter, slots 75 increase the resiliency of peripheral member 50 such that during the installation of hollow post 18 about mounting fittings 34 and 36, the perimeter of peripheral member 50 is reducible due to the forced contraction of slots 75 at their outer ends 77. It will be appreciated by those skilled in the art that other equivalent structures are available to increase the resiliency of peripheral member 50.

With reference to FIG. 4, peripheral member 50 defines an arcuate segment 74 in each of the first side 56, second side 58, and third side 60 thereof. Arcuate segments 74 are circumferentially spaced about a center 76 from which a first radius 78 defines inner arcuate surfaces 80 and a second radius 82 defines corresponding outer arcuate surfaces 83. It should be appreciated that second radius 82 is greater than first radius 78 by an amount equal to wall thickness 70.

The length of first radius 78 is established such that inner arcuate surfaces 80 cooperate to accommodate an outer surface of a mounting fitting installation tube (not shown) that assists in the positioning of mounting fittings 34 and 36 along stake 30. Specifically, the surface of web 54 proximate to inner arcuate surface 80 is designed to support a first end of the installation tube while the second and opposite end of the tube provides a surface that may be impacted with a tool such as a hammer. In this manner, a force exerted on the second end of the installation tube is transferred to one of mounting fittings 34 and 36 thereby moving the respective mounting fitting along mounting stake 30 to its respective positions thereon without disturbing the preferred configuration of the mounting fitting. Those skilled in the art will appreciate that while arcuate segments 74 form the preferred structure for positioning mounting fittings 34 and 36 along mounting stake 30, a variety of equivalent structures and methods may be used without departing from the scope of the invention claimed herein.

As is most clearly illustrated in FIG. 5, web 54 extends substantially perpendicularly from inner surface 64 of peripheral member 50 to housing 52 and includes a first surface 84 and a second surface 86 separated by a distance defining a web thickness 88. In the preferred embodiment, web 54 is connected to peripheral member 50 and housing 52 approximately at the midpoint of each of the respective members. Those skilled in the art will appreciate that the position of web 54 relative to peripheral member 50 and housing 52 may be varied without departing from the proper scope of the claimed invention.

Housing 52 includes an outer housing surface 90 connected to web 54, an inner housing surface 116 defining an aperture 94, and first and second end surfaces 96 and 98, respectively. Aperture 94 generally defines an open area similar in shape to the preferred cross-section of mounting stake 30 (FIG. 2) and extends from first end surface 96 to second end surface 98 of housing 52. Specifically, as best seen in FIG. 4, aperture 94 defines first and second aperture legs 100 and 102, respectively, about a first longitudinal axis 104 and third and fourth aperture legs 106 and 108, respectively, about a second longitudinal axis 110. First and second longitudinal axes 104 and 110, respectively, perpendicularly intersect at center 112. Aperture 94 includes an end slot 114 formed in a terminal end 115 of at least one of legs 100, 102, 104 and 106. It should be appreciated by those skilled in the art that end slots 114 provide housing 52 with increased flexibility to accommodate the manufacturing variations in mounting stakes 30.

Similarly, mounting fittings 34 and 36 each preferably include a plurality of semi-circular ridges 118 formed within aperture 94. Ridges 118 provide resilient engaging members that further accommodate the variations in the manufacture of mounting stakes 30 as well as broadening the manufacturing tolerances associated with mounting fittings 34 and 36. Specifically, semi-circular ridges 118 extend from and between first and second end surfaces 96 and 98, respectively, of housing 52 and project into aperture 94 from inner housing surface 116. As illustrated in FIG. 5, ridges 118 converge toward inner surface 116 proximate to first and second end surfaces 96 and 98, respectively.

With reference to FIGS. 2 and 3, hollow post 18 is shown to include an interior surface 124 and an exterior surface 126. While the preferred embodiment of the present invention discloses that interior and exterior surfaces 124 and 126, respectively, each generally define a square with rounded corners, it will be appreciated by those skilled in the art that a variety of post configurations may be used without departing from the scope of the claimed invention. Regardless of its configuration, hollow post 18 is disposed about stake 30 and mounting fittings 34 and 36, respectively, such that inner surface 124 of post 18 frictionally engages at least the two corners 59 and 61 of mounting fittings 34 and 36 and, preferably, all three corners 57, 59, and 61 thereof. Once post 18 is properly positioned about mounting fittings 34 and 36, a self-drilling screw 128 may be used to connect hollow post 18 to mounting fitting 34 or 36 thereby preventing the inadvertent removal of post 18. A post top 20 is secured to post 18 in order to cover open top 42.

It should be appreciated by those skilled in the art that ridges 118 and end slots 114 in housing aperture 94 as well as slots 75 and tapered portions 72 and 73 of peripheral member 50 can be included either separately or in combination in each mounting fitting 34 and 36 in order to increase the frictional forces generated thereby and/or to relax the tolerances to which the mounting fittings must be manufactured. Specifically, the open ends 117 of end slots 114 allow aperture 94 to expand when the mounting fitting is driven onto and along mounting stake 30. The expandable characteristic of mounting fittings 34 and 36 not only relaxes the manufacturing tolerances of aperture 94 but, in conjunction with the resilient nature of mounting fittings 34 and 36, provides a biasing force that urges aperture 94 into its original position thereby increasing the frictional forces between mounting stake 30 and housing 52.

It should be further appreciated that the incorporation of ridges 118 on inner surface 116 also reduces concern over the manufacturing tolerances of both mounting stake 30 and mounting fittings 34 and 36. As shown in FIG. 4, a similar ridge-like member 130 may be formed on or connected to corner 57 of peripheral member 50 in order to relax the required manufacturing tolerances of hollow post 18 and mounting fittings 34 and 36.

In a manner similar to end slots 114, slots 75 in peripheral member 50 relax the manufacturing tolerances of mounting fittings 34 and 36 and increase the frictional forces between the mounting fittings 34 and 36 and the hollow post 18. In the preferred embodiment, when hollow post 18 is slid over mounting stake 30 and mounting fittings 34 and 36, the inner surface 124 of hollow post 18 proximate to bottom end 44 thereof contacts the outer surface 62 of peripheral member 50 within tapered portion 72 (FIG. 3). Further downward movement of hollow post 18 causes open ends 77 of slots 75 to contract (FIG. 2) and hollow post 18 can be slid down the length of mounting stake 30. Again, not only do slots 75 relax the manufacturing tolerances of peripheral member 50 but, in conjunction with the resilient nature of mounting fittings 34 and 36, they also provide a biasing force that urges slots 75 into their original position thereby biasing corners 59 and 61 of peripheral member 50 against inner surface 124 of hollow post 18.

Figure 6:
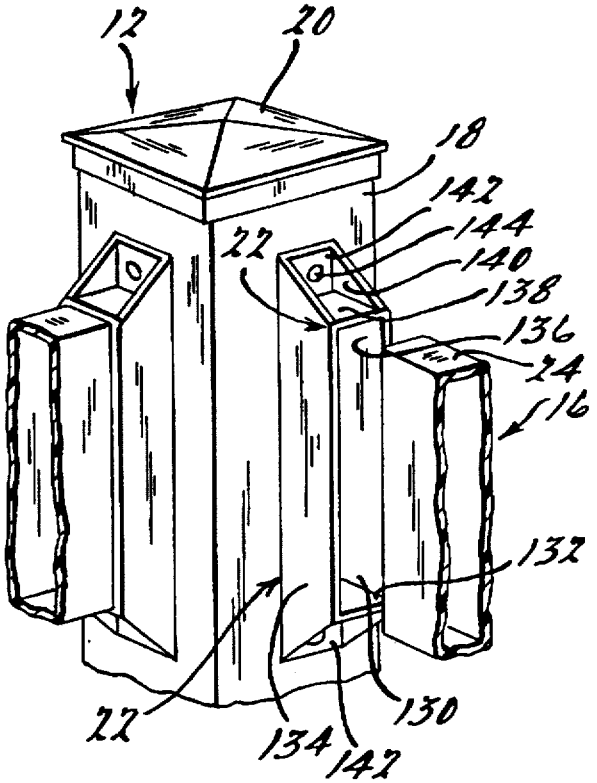
FIG. 6 is a partial perspective view of a post assembly having mounting brackets for post side mounting of the fence rails.
Figure 7:
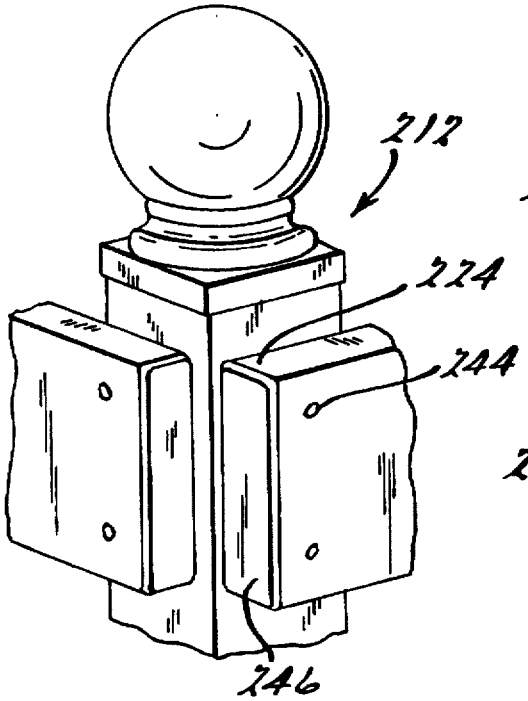
FIG. 7 is a partial perspective view of an end post assembly with post front mounted rails.
Figure 8:
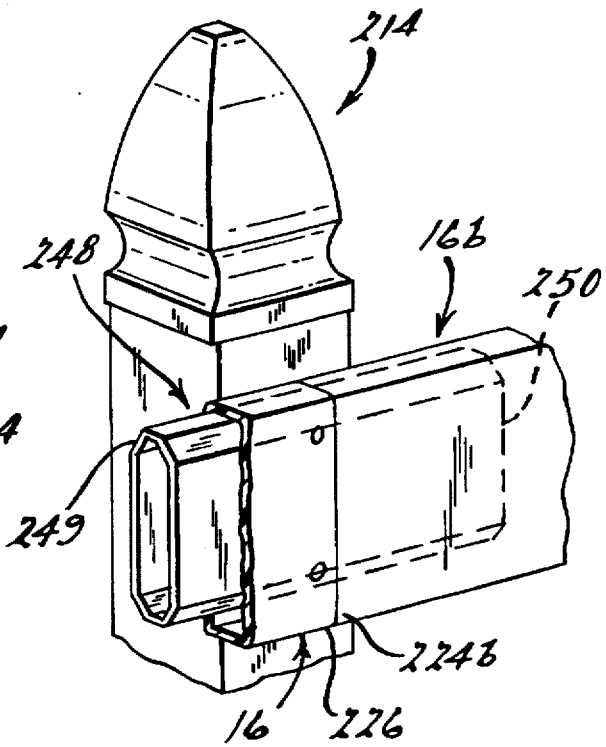
FIG. 8 is a partial perspective view of an intermediate post assembly having post front mounted rails.

Regarding the various mounting apparatuses available to connect rails 16 to hollow post 18, mounting brackets 22 provide a post side mount style while a post front mount style may be achieved through the use of end caps 246 and rail couplers 248 (FIGS. 7 and 8). As best seen in FIGS. 1, 3 and 6, mounting brackets 22 define a pocket 130 surrounded by a bottom wall 132, side walls 134 and 136, respectively, and a top wall 138. Webs 140 connect flanges 142 to top and bottom walls 132 and 138, respectively. Self-drilling screws 144 secure flanges 142 of mounting bracket 22 to hollow vinyl post 18 and first end 24 of rail 16 is slid into pocket 130. A second mounting bracket (not shown) is placed over the second end 26 of rail 16 and secured to second post assembly 14.

In the post front mount style shown in FIGS. 7 and 8, an end cap 246 is slip fit into first end 224 of rail 16 and secured thereto preferably through the use of a welding solvent known in the art. Rail 16 and end cap 246 are then secured to post assembly 212 by self-drilling screws 244. A rail coupler 248 (FIG. 8) interconnects adjacent rails and includes a first end 249 that is slip fit approximately halfway into second end 226 of rail 16 whereupon self-drilling screws 244 secure second end 226 of rail 16 to post assembly 214. The first end 224*b* of the next rail section 16*b* is disposed about the second end 250 of rail coupler 248. It will be appreciated by those skilled in the art that the post front and post side mount styles eliminate both the need to anticipate the slot locations in hollow posts 18 as well as the necessity of aligning the slot positions during installation. Those skilled in the art will also appreciate that various other structures and methods may be used to secure rails 16 to post assemblies 12 and 14 without departing from the scope of the appended claims.

Installation of post assemblies 12 and 14 begins with the driving of first end 46 of mounting stake 30 into the ground 28. First mounting fitting 34 is then located at the top 38 of mounting stake 30 such that aperture 94 aligns with the cross-sectional configuration of mounting stake 30. First mounting fitting 34 is driven down the length of mounting stake 30 to a position preferably six inches above the surface of the ground 28. In this position, ridges 118 of first mounting fitting 34 frictionally engage the exterior surface 31 of mounting stake 30 thereby securing mounting fitting 34 thereto. Second mounting fitting 36 is then located at the top 38 of mounting stake 30 such that housing aperture 94 of second mounting fitting 36 aligns with mounting stake 30. Mounting fitting 36 is driven along stake 30 preferably to a location approximately six inches below top 38 thereof. Again, ridges 118 frictionally engage the exterior surface 31 of mounting stake 30 to secure mounting fitting 36 thereto.

Hollow post 18 is disposed about mounting stake 30 so that the interior surface 124 proximate to bottom end 44 of post 18 contacts first tapered portion 72 of second mounting fitting 36. Post 18 is driven downwardly until bottom end 44 contacts or is proximate to the surface of the ground 28. In this position, inner surface 124 of post 18 frictionally engages at least the two corners 59 and 61 of each of the first and second mounting fittings 34 and 36, respectively. Once post 18 is properly positioned relative to stake 30, a self-drilling screw may be driven into post 18 and one of the first and second mounting fittings 34 and 36 to further prevent the inadvertent removal of hollow post 18. Post top 20 is then secured to the top 42 of hollow post 18.

Various other advantages and modifications will become apparent to one skilled in the art after having the benefit of studying the teachings of the specification, the drawings and the following claims.

What is claimed is:

1. A mounting fitting for securing a hollow post having an inner surface to a stake having a cross sectional configuration defining an outer surface, said mounting fitting comprising:

a first member having an inner surface defining an aperture, said aperture includes a first leg and a second leg formed about a first axis and a third leg and a fourth leg formed about a second axis, said first and second axes intersecting at a center, said first, second, third, and fourth legs each including a terminal end remote from said center, said first member further including first sizing means for elastically deforming said inner surface and enlarging said aperture whereby said first member slidably accommodates stakes of varying sizes, said first sizing means including a slot formed in said inner surface; and a second member connected to said first member, said second member defining a peripheral surface adapted to be engageable with the hollow post to frictionally couple the hollow post to the mounting fitting.

2. The mounting fitting of claim 1 wherein said first member further includes a housing defining said inner surface and having an outer housing surface, said mounting fitting further including a web connecting said outer housing surface to said second member, said inner surface extending between a first and a second end surface to define said aperture.

3. The mounting fitting of claim 1 wherein said first sizing means includes a ridge projecting into said aperture.

4. The mounting fitting of claim 1 wherein said slot is formed in said terminal end of at least one of said first, second, third, and fourth legs.

5. The mounting fitting of claim 1 wherein said second member further includes an inside surface connected to said first member, said second member having a first end surface and a second end surface interconnecting said inside surface and said peripheral surface, said second member further defining a first tapered section proximate to said first end surface wherein said peripheral surface converges toward said inside surface of said second member.

6. The mounting fitting of claim 5 further including a second tapered section proximate to said second end surface wherein said peripheral surface converges toward said inside surface of said second member.

7. The mounting fitting of claim 1 wherein said second member is substantially triangular in shape having corners for engaging the hollow post.

8. The mounting fitting of claim 7 wherein said second member includes a first side, a second side, and a third side, and wherein each of said first, second, and third sides include an arcuate segment.

9. The mounting fitting of claim 1 wherein said peripheral surface defines a circumferential length and said second member further includes second sizing means for elastically reducing the circumferential length of said peripheral surface in response to the positioning of the hollow post about the mounting fitting and against a biasing force of said mounting fitting.

10. The mounting fitting of claim 9 wherein said second sizing means includes a slot formed in said second member.

11. The mounting fitting of claim 9 wherein said second sizing means includes a ridge partially defining said peripheral surface.

12. A post assembly comprising:

a stake defining an outer stake surface;

a hollow post defining an inner post surface; and a first mounting fitting including a first member, a second member, and a web, said first member including a housing defining an inner surface and an outer housing surface, said web connecting said outer housing surface to said second member, said inner surface defining an aperture disposed about said stake such that said first member engages said outer stake surface and frictionally supports said mounting fitting about said stake, said second member defining a peripheral surface engaging said inner post surface to frictionally support said hollow post about said mounting fitting, said peripheral surface defining a circumferential length, said first mounting fitting further including one of first resilient sizing means for elastically deforming said inner surface and enlarging said aperture whereby said first member slidably accommodates stakes of varying sizes within said aperture and second resilient sizing means for elastically reducing the circumferential length of said peripheral surface to slidably accommodate posts of varying sizes about said second member.

13. The post assembly of claim 12 wherein said aperture includes a first leg and a second leg formed about a first axis and a third leg and a fourth leg formed about a second axis, said first and second axes intersecting at a center, said first, second, third, and fourth legs each including a terminal end remote from said center, said first resilient sizing means including a slot formed in said terminal end of at least one of said first, second, third, and fourth legs, said second resilient means includes a slot formed in said second member.

14. The post assembly of claim 12 wherein a portion of said stake is driven into a surface thereby fixing said post assembly to said surface, said post assembly further including a second mounting fitting, said stake having a top positioned above said surface, said first mounting fitting frictionally engaging said stake approximately six inches above said surface, said second mounting fitting frictionally engaging said stake approximately six inches below said top of said stake.

15. A polymeric fence comprising:

a first post assembly including a first stake defining an outer surface, a first hollow post defining an inner surface, and a first mounting fitting, said first mounting fitting including a first member and a second member, said first member having a web connected to said second member, said first member having an inner surface defining an aperture disposed about said first stake such that said first member engages said outer surface of said first stake and frictionally supports said first mounting fitting about said first stake, said second member defining a peripheral surface engaging said inner surface of said first hollow post to frictionally support said first hollow post about said first mounting fitting, said peripheral surface defining a circumferential length;

a second post assembly including a second stake defining an outer surface, a second hollow post defining an inner surface, and a second mounting fitting, said second mounting fitting including a first member and a second member, said first member having a web connected to said second member, said first member defining an aperture disposed about said second stake such that said first member engages said outer surface of said second stake and frictionally supports said second mounting fitting about said second stake, said second member defining a peripheral surface engaging said inner surface of said second hollow post to frictionally support said second hollow post about said second mounting fitting, said peripheral surface defining a circumferential length;

each of said first and second mounting fittings including one of first resilient sizing means defined by said first member and second resilient sizing means defined by said second member, said first resilient sizing means for elastically deforming said inner surface of said first member and enlarging said aperture whereby said first member slidably accommodates stakes of varying sizes within said aperture, said second resilient sizing means for elastically reducing the circumferential lengths of said peripheral surfaces to slidably accommodate posts of varying sizes about said second member; and a rail having a first end connected to said first post assembly and a second end connected to said second post assembly.

* * * * *